US010507561B2

(12) United States Patent
Kanazawa et al.

(10) Patent No.: US 10,507,561 B2
(45) Date of Patent: Dec. 17, 2019

(54) GRINDING APPARATUS

(71) Applicant: TOKYO SEIMITSU CO., LTD, Tokyo (JP)

(72) Inventors: Masaki Kanazawa, Tokyo (JP); Makoto Shimoda, Tokyo (JP)

(73) Assignee: Tokyo Seimitsu Co., LTD, Tokyo (JP)

( * ) Notice: Subject to any disclaimer, the term of this patent is extended or adjusted under 35 U.S.C. 154(b) by 99 days.

(21) Appl. No.: 15/842,658

(22) Filed: Dec. 14, 2017

(65) Prior Publication Data

US 2018/0215006 A1 Aug. 2, 2018

(30) Foreign Application Priority Data

Jan. 30, 2017 (JP) ..... 2017-014128

(51) Int. Cl.
*B24B 7/22* (2006.01)
*B24B 51/00* (2006.01)
*B24B 49/12* (2006.01)

(52) U.S. Cl.
CPC ..... *B24B 7/228* (2013.01); *B24B 49/12* (2013.01); *B24B 51/00* (2013.01)

(58) Field of Classification Search
CPC . B24B 7/228; B24B 27/0023; B24B 27/0069; B24B 49/04; B24B 49/12; B24B 51/00
(Continued)

(56) References Cited

U.S. PATENT DOCUMENTS 5,816,891 A * 10/1998 Woo ..... B24B 37/04 451/6
6,431,949 B1 * 8/2002 Ishikawa ..... B24B 7/228 451/21
(Continued)

FOREIGN PATENT DOCUMENTS

JP S59-134656 8/1984
JP H11-267968 10/1999
(Continued)

OTHER PUBLICATIONS

Japanese Office Action dated Apr. 12, 2018 in corresponding Japanese patent application No. 2017-014128 and English Translation, 7 pages.
(Continued)

*Primary Examiner* — George B Nguyen
(74) *Attorney, Agent, or Firm* — Fattibene and Fattibene LLC; Paul A. Fattibene

(57) ABSTRACT

A grinding apparatus that performs thickness measurement across an entire wafer surface without degradation of throughput of wafer grinding and grinds the wafer precisely to a target thickness. A grinding apparatus includes a rough grinding stage for roughly grinding a wafer and a fine grinding stage for finely grinding the wafer. A first thickness measuring means for measuring the thickness of the wafer while the wafer is being transferred is provided to a column so disposed as to span an index table. A control unit of the grinding apparatus corrects a target thickness after fine grinding and computes a target thickness after correction on the basis of an average thickness across the entire surface of the wafer before fine grinding obtained from measured values of the first thickness measuring means.

6 Claims, 9 Drawing Sheets

(58) Field of Classification Search
USPC ..... 451/5, 6, 8, 57, 41, 285–290
See application file for complete search history.

(56) References Cited

U.S. PATENT DOCUMENTS

| | | | | |
|---|---|---|---|---|
| 6,431,964 | B1 * | 8/2002 | Ishikawa | B24B 7/228 257/E21.23 |
| 7,022,000 | B2 * | 4/2006 | Mizomoto | B24B 7/228 451/288 |
| 7,101,254 | B2 * | 9/2006 | Swedek | B24B 37/005 451/286 |
| 8,366,514 | B2 * | 2/2013 | Ide | B24B 37/00 451/287 |
| 2002/0173084 | A1 * | 11/2002 | Ohkawa | G01B 11/0625 438/149 |
| 2004/0014401 | A1 * | 1/2004 | Tsao | B24B 7/228 451/57 |
| 2004/0235391 | A1 * | 11/2004 | Grivna | B24B 7/06 451/5 |
| 2005/0070210 | A1 * | 3/2005 | Jeong | B24B 37/013 451/8 |
| 2009/0247052 | A1 * | 10/2009 | Arisa | B24B 37/042 451/8 |
| 2014/0113526 | A1 * | 4/2014 | Kipper | H01L 21/6835 451/5 |

FOREIGN PATENT DOCUMENTS

| | | |
|---|---|---|
| JP | 2002-052444 | 2/2002 |
| JP | 2009-050944 | 3/2009 |
| JP | 2009-233809 | 10/2009 |
| JP | 2010-069549 | 4/2010 |
| JP | 2016-010838 | 1/2016 |
| JP | 2016-016457 | 2/2016 |
| JP | 2016016457 | 2/2016 |
| JP | 2016-201422 | 12/2016 |

OTHER PUBLICATIONS

Japanese Office Action dated May 28, 2018 in corresponding Japanese patent application No. 2017-014128 and English Translation, 9 pages.

* cited by examiner

GRINDING APPARATUS

BACKGROUND OF THE INVENTION

1. Field of the Invention

The present invention relates to a grinding apparatus for grinding the back side of a wafer.

2. Description of the Related Art

In the field of semiconductor manufacturing, back grinding for grinding the back side of a wafer is performed in order to thin a semiconductor wafer, such as a silicon wafer (referred to below as "wafer"). As a grinding apparatus for performing such back grinding, one that roughly grinds a wafer thicker than a target thickness and thereafter finely grinds the roughly-ground wafer to the target thickness is known.

In Japanese Patent Application No. 2016-16457, a grinding apparatus that measures the thickness of a wafer with a contact-type thickness measuring means during the rough grinding or fine grinding is disclosed. The positions of measurement where the thickness measuring means measures the thickness of the wafer are arranged on a plurality of concentric circles centered at the center of the wafer and having different diameters.

However, in such a grinding apparatus disclosed in Japanese Patent Application No. 2016-16457 as described above, since the measurement of the thickness of the wafer is performed while the rough grinding or fine grinding is being performed, a grinding wheel must be retreated upward, for example, when the thickness at the center of the wafer is measured, and therefore such a problem occurs that the throughput of wafer grinding is reduced.

Under these circumstances, a technical problem to be solved is that thickness measurement across an entire surface of a wafer is performed without degradation of the throughput of wafer grinding and the wafer is precisely ground to a target thickness, and an object of the present invention is to solve the problem.

SUMMARY OF THE INVENTION

The present invention is suggested in order to achieve the above object, and a first aspect of the invention provides a grinding apparatus provided with a rough grinding stage for roughly grinding a wafer, a fine grinding stage for finely grinding the wafer, and a transfer means for transferring the wafer, the grinding apparatus including a thickness measuring means for measuring a thickness of the wafer while the wafer is being transferred, and a control means for computing a thickness of the wafer before the fine grinding on the basis of measured values of the thickness measuring means and correcting a target thickness after the fine grinding.

According to the structure of the first aspect of the invention, since the thickness of the wafer is measured while the wafer is being transferred, the thickness across an entire surface of the wafer can be measured with the throughput kept and the wafer can be ground precisely to the target thickness.

A second aspect of the invention provides a grinding apparatus having a structure, in addition to the structure of the first aspect of the invention, wherein the control means computes an average thickness across an entire surface of the wafer before the fine grinding on the basis of the measured values of the thickness measuring means and corrects the target thickness after the fine grinding.

According to the structure of the second aspect of the invention, since the control unit corrects the target thickness of the wafer after the fine grinding on the basis of the average thickness across the entire surface of the wafer while taking into consideration whether the thickness of the wafer is thin or thick, excessive or insufficient grinding, which often occurs when the wafer having waviness is ground, can be prevented or reduced.

A third aspect of the invention provides a grinding apparatus having a structure, in addition to the structure of the first or second aspect of the invention, wherein a wafer chuck for holding the wafer rotates the wafer when the thickness measuring means measures the thickness of the wafer.

According to the third aspect of the invention, since the measuring spots of the thickness measuring means are scanned on the wafer without movement of the thickness measuring means, the thickness measuring means can be installed in a space-saving manner and, at the same time, the thickness across the entire surface of the wafer is measured with the thickness measuring means, so that the wafer can be ground precisely to the target thickness.

A fourth aspect of the invention provides a grinding apparatus having a structure, in addition to any one of the structures of the first to third aspects of the invention, wherein a measuring spot of the thickness measuring means is set to pass through a locus of transfer of a center of the wafer.

According to the structure of the fourth aspect of the invention, since the thickness across the entire surface of the wafer including the center of the wafer is measured while the wafer is being transferred, the thickness across the entire surface of the wafer is measured with the throughput of wafer grinding kept, so that the wafer can be ground precisely to the target thickness.

A fifth aspect of the invention provides a grinding apparatus having a structure, in addition to any one of the structures of the first to fourth aspects of the invention, wherein the thickness measuring means is a non-contact in-process gauge (NCIG) using spectral interference.

According to the structure of the fifth aspect of the invention, since the thickness across the entire surface of the wafer is measured with a non-contact in-process gauge (NCIG) using spectral interference while the wafer is being transferred, the thickness across the entire surface of the wafer is precisely measured with the throughput of wafer grinding kept, so that the wafer can be ground precisely to the target thickness.

A sixth aspect of the invention provides a grinding apparatus having a structure, in addition to any one of the structures of the first to fifth aspects of the invention, wherein the thickness measuring means is attached to a column so disposed as to span the transfer means.

According to the structure of the sixth aspect of the invention, since the thickness measuring means can be installed in the column opposite the transfer means, the thickness measuring means can be easily provided without additional preparation of a jig or the like for placing the thickness measuring means.

A seventh aspect of the invention provides a grinding apparatus further including, in addition to any one of the structures of the first to sixth aspects of the invention, a finished thickness measuring means for measuring a thickness at one arbitrary point of the wafer in the fine grinding stage, and having a structure wherein the control means corrects the target thickness after the fine grinding again on the basis of a correction value involved in a shape variation of the wafer obtained by subtracting a difference in the average thickness across the entire surface of the wafer between before and after the fine grinding measured by the thickness measuring means from a difference in the thickness at one arbitrary point of the wafer between before and after the fine grinding measured by the finished thickness measuring means.

According to the structure of the seventh aspect of the invention, since a shape variation of the wafer before and after the fine grinding (a trend of the fine grinding) is taken into consideration to correct the target thickness again, the wafer can be further precisely ground.

Since the present invention measures the thickness of the wafer while the wafer is being transferred, the present invention measures the thickness across the entire surface of the wafer with the throughput kept, so that the wafer can be precisely ground to the target thickness.

DETAILED DESCRIPTION OF THE PREFERRED EMBODIMENT

In order to achieve the object that thickness measurement across an entire surface of a wafer is performed without degradation of the throughput of wafer grinding and the wafer is ground precisely to a target thickness, a grinding apparatus according to the present invention is embodied by a grinding apparatus provided with a rough grinding stage for roughly grinding a wafer, a fine grinding stage for fine grinding the wafer, and a transfer means for transferring the wafer, the grinding apparatus including a thickness measuring means for measuring the thickness of the wafer while the wafer is being transferred, and a control means for computing the thickness of the wafer before fine grinding on the basis of measured values of the thickness measuring means and correcting a target thickness after the fine grinding.

Herein below, a grinding apparatus 1 according to an embodiment of the present invention is described with reference to the drawings. It should be noted that, when the number, value, amount, range or the like of components is referred to in the embodiment described below, the number is not limited to the specific number but may be more or less than the specific number, unless otherwise explicitly stated and unless, in principle, the number is obviously limited to the specific number.

In addition, when the shapes or positional relationship of the components or the like are referred to, shapes or the like that are substantially approximate or similar to the shape or the like are included, unless otherwise explicitly stated and except such a case where, in principle, the shapes or the like are obviously not included.

Furthermore, the drawings may be exaggerated, for example, by enlarging a characteristic part, in order to make it easier to understand the feature, and therefore the dimensional ratio or the like of the components may not necessarily be true to the actual ratio or the like. In addition, in the sectional view, hatching of some of the components may be omitted in order to make it easier to understand the sectional structures of the components.

Figure 1:
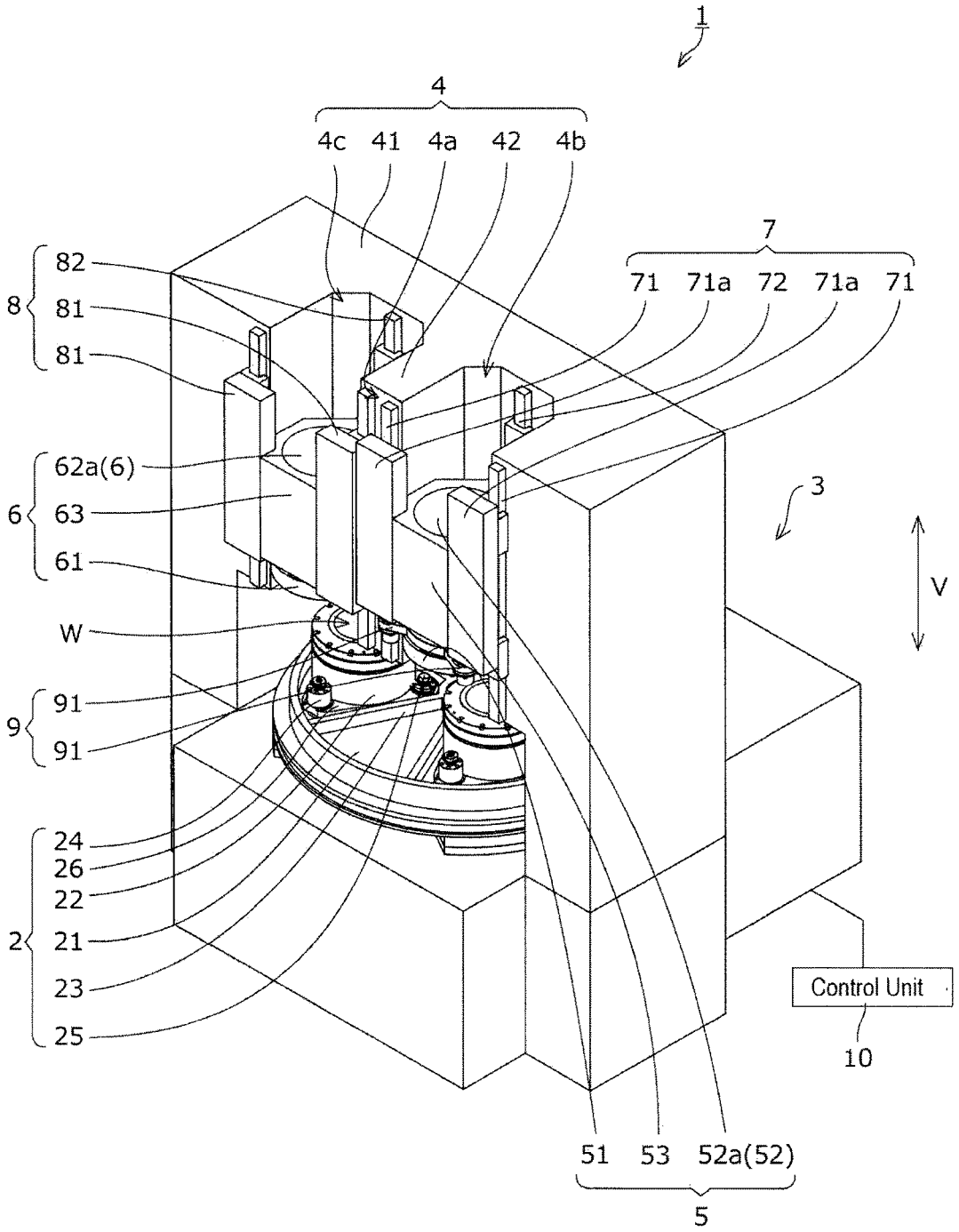
FIG. 1 is a perspective view illustrating a grinding apparatus according to an embodiment of the present invention.
Figure 2:
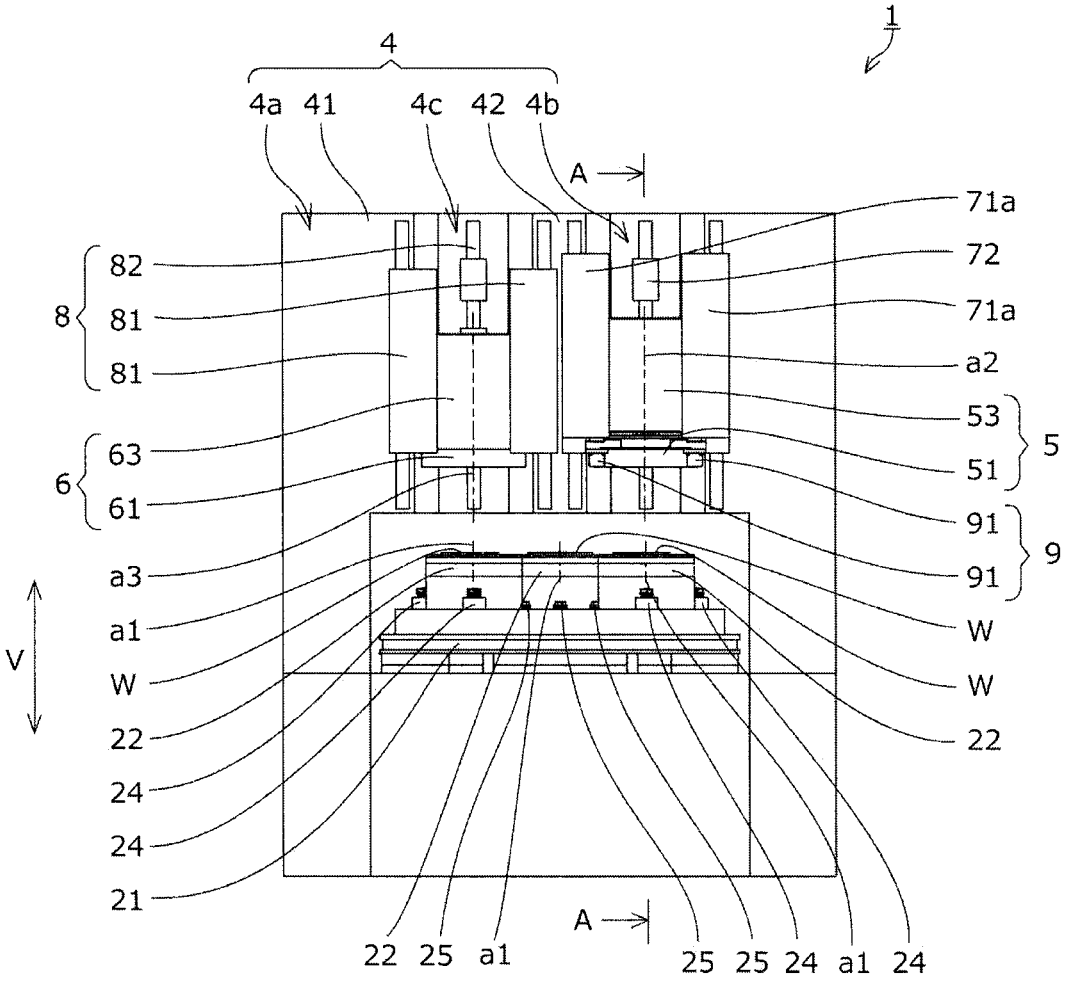
FIG. 2 is a front view of the grinding apparatus illustrated in FIG. 1.
Figure 3A:
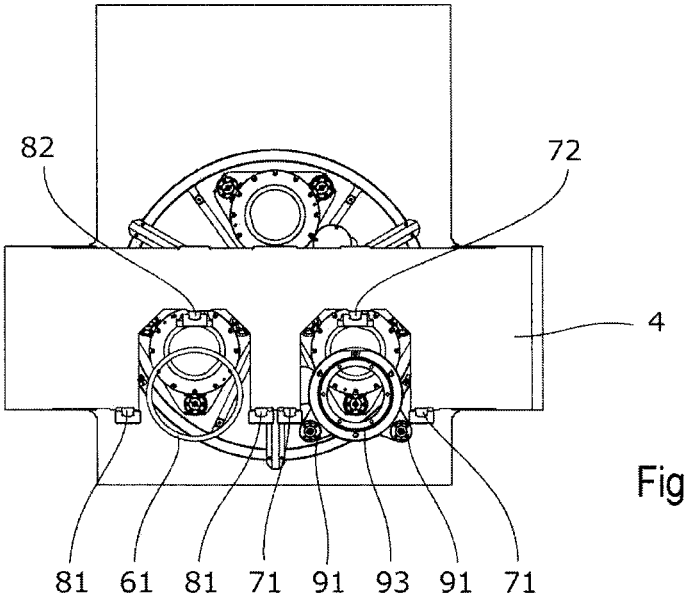
FIGS. 3A and 3B are plan views of a main unit illustrated in FIG. 1, FIG. 3A being a plan view having a first spindle and a second spindle omitted, FIG. 3B being a plan view having a column omitted.
Figure 3B:
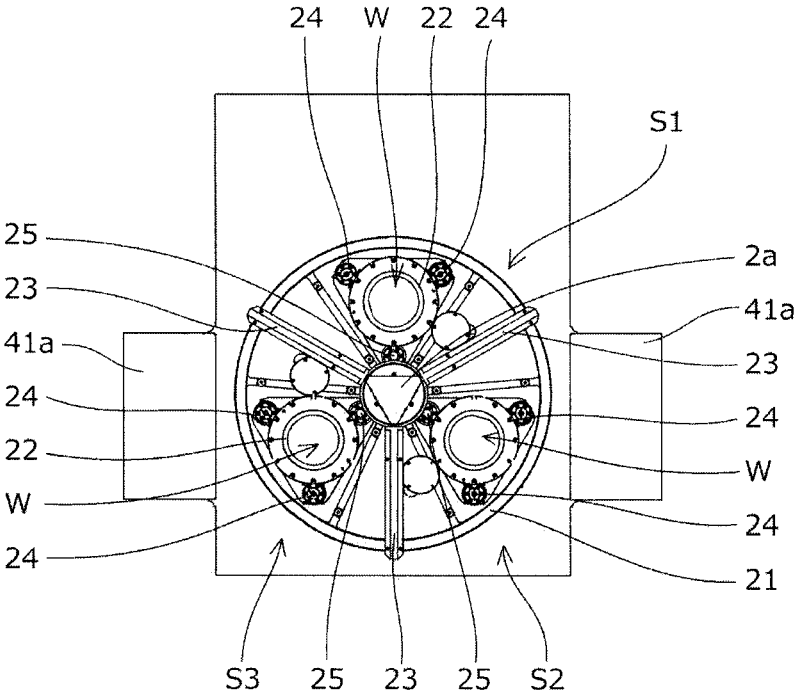
Figure 4:
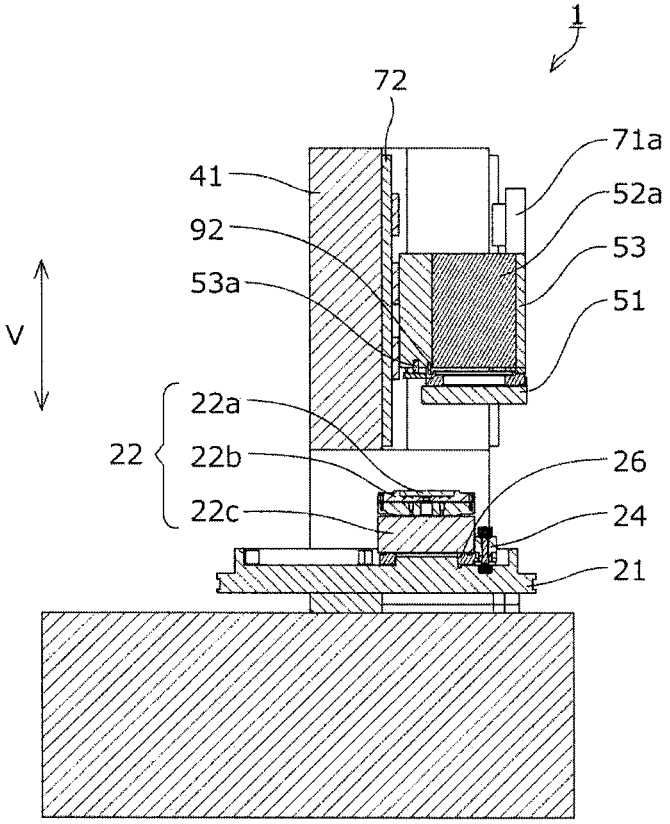
FIG. 4 is a sectional view taken along line A-A of FIG. 2.
Figure 5:
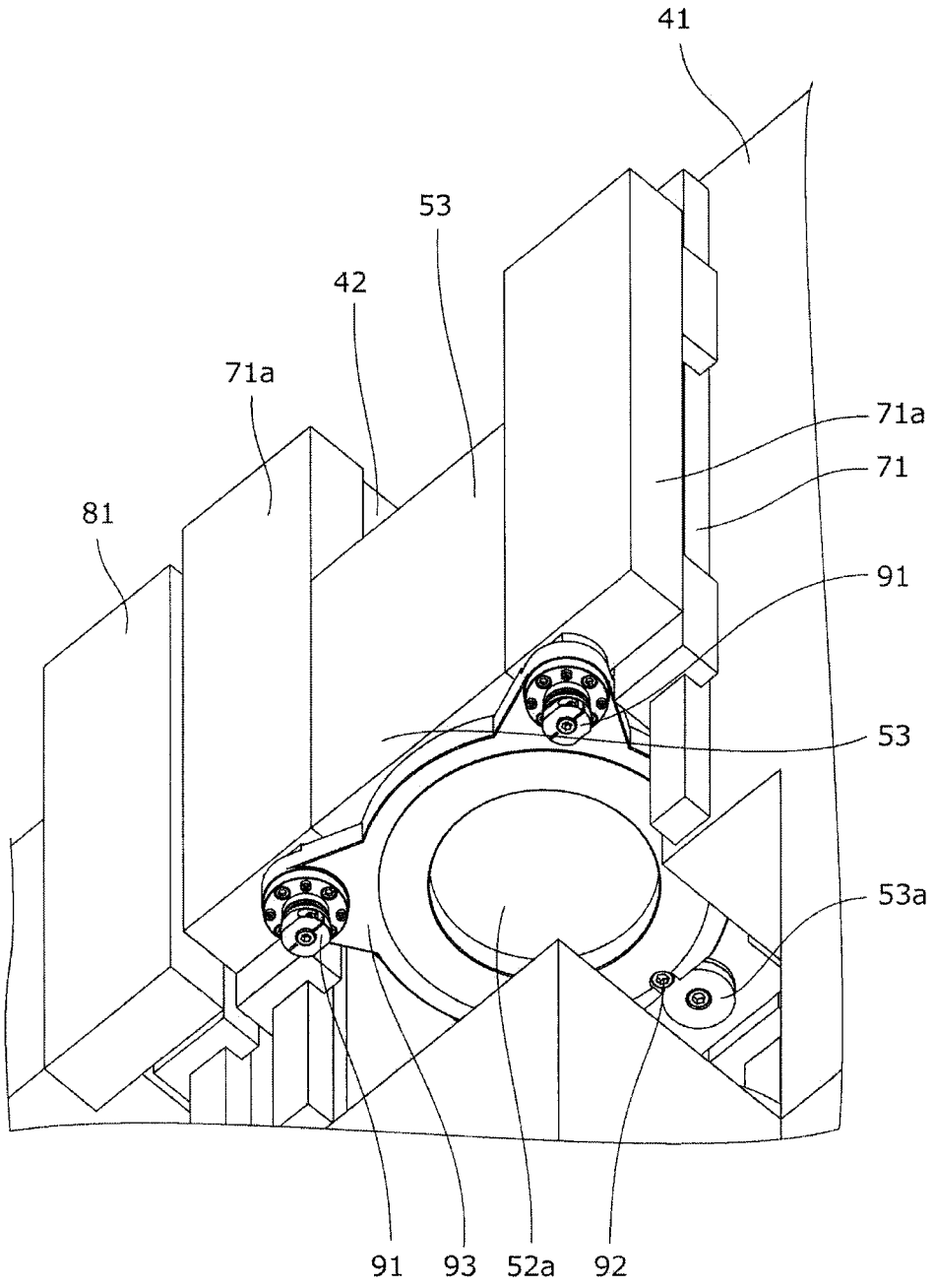
FIG. 5 is a perspective view of a rough grinding means as viewed from below, having a rough grinding wheel omitted.

FIG. 1 is a perspective view illustrating the basic structure of the grinding apparatus 1. FIG. 2 is a front view of the grinding apparatus 1. FIG. 3A is a plan view illustrating the grinding apparatus 1 having a first spindle 52 and a second spindle 62 of FIG. 1 omitted. FIG. 3B is a plan view of the grinding apparatus 1 having a column 4 of FIG. 3A omitted. FIG. 4 is a sectional view taken along line A-A of FIG. 2. FIG. 5 is a perspective view of a rough grinding means 5 as viewed from below having a rough grinding wheel 51 omitted.

The grinding apparatus 1 continuously grinds a wafer with two grinding wheels disposed side by side. The grinding apparatus 1 thins a wafer W by back grinding. The wafer W subjected to grinding using the grinding apparatus 1 may be, though not limited to, a silicon wafer, a silicon carbide wafer or the like. The grinding apparatus 1 is provided with a holding means 2 and a main unit 3 disposed above the holding means 2.

The holding means 2 is provided with an index table 21 capable of rotating around a rotary shaft 2*a* coupled to a motor, not shown, and three chucks 22 mounted on the index table 21.

The chucks 22 are spaced at 120 degree intervals on the circumference of a circle centered at an axis of rotation a1. The chuck 22 is provided with a suction body 22*a* made of a porous ceramic buried in its upper surface. A conduit 22*b* formed in the chuck 22 is connected to a source of vacuum, not shown, which uses negative pressure to suck and hold the wafer W placed on the chuck 22. The chuck 22 is coupled to a motor, not shown, and capable of rotating on the axis of rotation a1. An air bearing 22*c* is provided below the chuck 22 so that the chuck 22 can be smoothly rotated.

The holding means 2 are segmented into an alignment stage S1, a rough grinding stage S2, and a fine grinding stage S3. Partitions 23 are disposed between the chucks 22 to prevent a working fluid used at each stage from scattering to the adjacent stages.

The alignment stage S1 is a stage at which the wafer W is carried onto the chuck 22 by a carrying device, not shown, and the wafer W is aligned with a predetermined position. By the index table 21 rotating clockwise in FIG. 3B, the wafer W sucked and held on the chuck 22 is transferred to the rough grinding stage S2.

The rough grinding stage S2 is a stage at which the wafer W is roughly ground. By the index table 21 rotating clockwise in FIG. 3B, the wafer W roughly ground is transferred to the fine grinding stage S3.

The fine grinding stage S3 is a stage at which the wafer W is finely ground. By the index table 21 rotating counterclockwise in FIG. 3B, the wafer W is transferred to the alignment stage S1, and put into a rack or the like, not shown, from the chuck 22 by a carrying device or the like, not shown.

The holding means 2 is provided with two first movable supporting portions 24 and one first fixed supporting portion 25 disposed around the chuck 22, as shown in FIG. 3B. The first movable supporting portions 24 are disposed outside the chuck 22 in a diametrical direction of the index table 21. The first fixed supporting portion 25 is disposed inside the chuck 22 in a diametrical direction of the index table 21.

The first movable supporting portions 24 constitutes a known differential screw mechanism for raising and lowering the tilt table 26 on which the chuck 22 is placed. The first fixed supporting portion 25 is a bolt fastening the tilt table 26 to the index table 21.

Since the first movable supporting portions 24 raise and lower the tilt table 26 and, at the same time, the first fixed supporting portion 25 fixes the tilt table 26 in vertical directions V, an angle between the axis of rotation a1 of the chuck 22 and an axis of rotation a2 of the rough grinding wheel 51 or an axis of rotation a3 of a fine grinding wheel 61 described later can be controlled according to each extension or retraction amount of the two first movable supporting portions 24.

The main unit 3 is provided with an arch-like column 4 so disposed as to span the index table 2, the rough grinding means 5 attached to the column 4 above the rough grinding stage S2, and a fine grinding means 6 attached to the column 4 above the fine grinding stage S3.

The column 4 is provided with a base portion 41 formed in an inverted-U shape as viewed from front, and a central column portion 42 protruded in a horizontal direction from the center of the base portion 41, such that the column 4 is formed in the shape of E as viewed from above.

The base portion 41 is so disposed as to span the rough grinding stage S2 and the fine grinding stage S3. Thereby, as viewed from above, the alignment stage S1 is exposed at a side of the column 4. Therefore, when carrying the wafer W onto the chuck 22 or away from the chuck 22, the carrying device or the like can access the chuck 22 without being interfered with by the column 4. The base portion 41 couples two posts 41*a* standing outside the index table 21, thereby increasing the rigidity of the base portion 41.

The central column portion 42 is disposed between the rough grinding stage S2 and the fine grinding stage S3 as viewed from above. A lower end of the central column portion 42 is extended to above the index table 21.

A first thickness measuring means M1 is disposed at a lower end face of the central column portion 42. The first thickness measuring means measures the thickness of the wafer W in a contactless manner and may be, though not limited to, a non-contact in-process gauge (NCIG) using spectral interference, for example.

The first thickness measuring means M1 is disposed immediately above the locus of transfer of the center of the wafer W when the index table 21 transfers the wafer W between the rough grinding stage S2 and the fine grinding stage S3.

In a front face 4*a* of the column 4, grooves 4*b*, 4*c* formed in the vertical directions V are disposed side by side. The rough grinding means 5 is contained in the groove 4*b*. Similarly, the fine grinding means 6 is contained in the groove 4*c*.

The rough grinding means 5 is provided with the rough grinding wheel 51, the first spindle 52 having the rough grinding wheel 51 at its lower end, and a first spindle feed mechanism 53 for raising and lowering the first spindle 52 in the vertical directions V.

The rough grinding wheel 51 is composed of a plurality of cup-type grinding wheels disposed circumferentially at the lower end.

The first spindle 52 is provided with a saddle 52*a* having the rough grinding wheel 51 attached to its lower end, and a motor, not shown, provided in the saddle 52*a* for rotating the rough grinding wheel 51.

The first spindle feed mechanism 53 couples the saddle 52*a* and a rear guide 72 described later and feeds the first spindle 52 in the vertical directions V. It should be noted that, though a raising and lowering means for feeding the first spindle 52 is omitted from the first spindle feed mechanism 53, the raising and lowering means may be a motor-driven ball screw or the like, for example.

An in-process gauge, not shown, for measuring the thickness of the wafer W is provided in the rough grinding stage S2. When the thickness of the wafer W measured by the in-process gauge reaches a desired value, the first spindle feed mechanism 53 drives the saddle 52*a* to rise, and thereby the wafer W and the rough grinding wheel 51 are separated.

The fine grinding means 6 is provided with the fine grinding wheel 61, a second spindle 62 having the fine grinding wheel 61 attached to its lower end, and a second spindle feed mechanism 63 for raising and lowering the second spindle 62 in the vertical directions V. It should be noted that the basic structure of the fine grinding means 6 corresponds to the basic structure of the rough grinding means 5, and therefore the corresponding description is omitted.

The fine grinding wheel 61 is composed of a plurality of cup-type grinding wheels arranged circumferentially at the lower end.

The second spindle 62 is provided with a saddle 62*a* having the fine grinding wheel 61 attached to its lower end, and a motor, not shown, provided in the saddle 62*a* for rotating the fine grinding wheel 61.

The second spindle feed mechanism 63 has a similar structure to the first spindle feed mechanism 53, couples the saddle 62*a* and a rear guide 82 described later, and feeds the second spindle 62 in the vertical directions V.

A second thickness measuring means M2, described later, for measuring the thickness of the wafer W is provided in the fine grinding stage S3. The second thickness measuring means M2 may be an in-process gauge, for example. A measuring system of the second thickness measuring means may be of a contact type or a contactless type. In addition, the second thickness measuring means may move its measuring spot in a radial direction of the wafer W. When the thickness of the wafer W measured by the second thickness measuring means M2 reaches a desired value, the second spindle feed mechanism 63 drives the saddle 62*a* to rise, and thereby the wafer W and the fine grinding wheel 61 are separated.

The grinding apparatus 1 is provided with a first guide 7 supporting the first spindle 52 slidably in the vertical directions V, and a second guide 8 supporting the second spindle 62 slidably in the vertical directions V.

The first guide 7 is composed of front guides 71 each of which is disposed on front faces of the base portion 41 and the central column portion 42 and one rear guide 72 disposed in the groove 4*b*. The front guides 71 and the rear guide 72 may be linear guides, for example. The saddle 52*a* is directly attached to sliders 71*a* of the front guides 71. In addition, the saddle 52*a* is attached to the rear guide 72 via the first spindle feed mechanism 53.

The front guides 71 and the rear guide 72 are disposed parallel to each other in the vertical directions V. Thereby, the front guides 71 and the rear guide 72 restrict the saddle 52*a* to move in the vertical directions V.

The second guide 8 is composed of front guides 81 each of which is disposed on front faces of the base portion 41 and the central column portion 42 and one rear guide 82 disposed in the groove 4*c*. The front guides 81 and the rear guide 82 may be linear guides, for example. The saddle 62*a* is directly attached to the front guides 81. In addition, the saddle 62*a* is attached to the rear guide 82 via the second spindle feed mechanism 63.

The front guides 81 and the rear guide 82 are disposed parallel to each other in the vertical directions V. Thereby, the front guides 81 and the rear guide 82 restrict the saddle 62*a* to move in the vertical directions V.

The grinding apparatus 1 is provided with a tilting means 9 for tilting the axis of rotation a2 of the rough grinding wheel 51. The tilting means 9 is provided with two second movable supporting portions 91 and one second fixed supporting portion 92 disposed around the rough grinding wheel 51, as shown in FIG. 5. The second movable supporting portions 91 are disposed in front of the rough grinding wheel 51. The second fixed supporting portion 92 is disposed opposite the second movable supporting portions 91 across the rough grinding wheel 51.

The second movable supporting portions 91 constitutes a known differential screw mechanism for raising and lowering a tilt table 93. The second fixed supporting portion 92 is a bolt fastening the tilt table 93 to the first spindle feed mechanism 53.

Since the second movable supporting portions 91 raise and lower the tilt table 93 and, at the same time, the second fixed supporting portion 92 fixes the tilt table 93 in the vertical directions V, an angle between the axis of rotation a2 of the rough grinding wheel 51 and the axis of rotation a1 of the chuck 22 can be controlled according to each extension or retraction amount of the two second movable supporting portions 91.

The operation of the grinding apparatus 1 is controlled by a control unit 10. The control unit 10 controls each of components composing the grinding apparatus 1. The control unit 10 may be composed of a CPU, a memory and the like, for example. It should be noted that the function of the control unit 10 may be embodied by controlling the operation of the grinding apparatus 1 using a software, or may be embodied by operating the grinding apparatus 1 using a hardware.

In this manner, the grinding apparatus 1 continuously feeds the wafer W sucked and held by the chuck 22 of the alignment stage S1 and placed on the same chuck 22 to the rough grinding stage S2 and the fine grinding stage S3 in this order. Furthermore, the chuck 22 for sucking and holding the wafer W can be so formed as to be more rigid than another wafer holding device, such as a belt conveyor. Thereby, the throughput of grinding is improved and, at the same time, high quality grinding of the wafer W can be performed.

Furthermore, since the column 4 is larger in diameter than the index table 21 and can be so formed as to have high rigidity, resonance and shaft slanting of the rough grinding means 5 and the fine grinding means 6 due to the normal force generated during grinding of the wafer W are prevented or reduced, and therefore high quality grinding of the wafer W can be performed.

Figure 6:
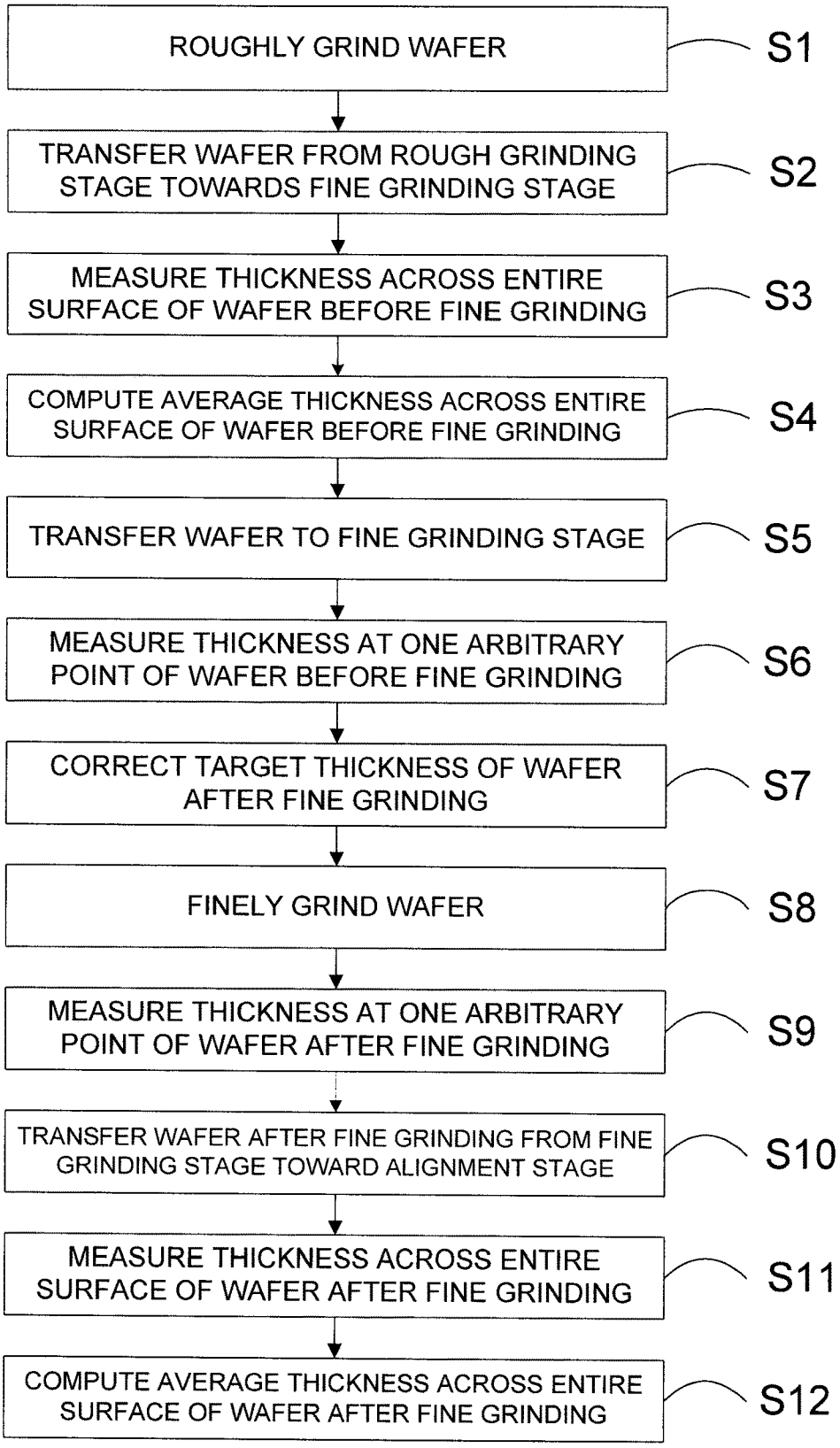
FIG. 6 is a flowchart illustrating a procedure for roughly grinding and finely grinding a wafer with the grinding apparatus.
Figure 7A:
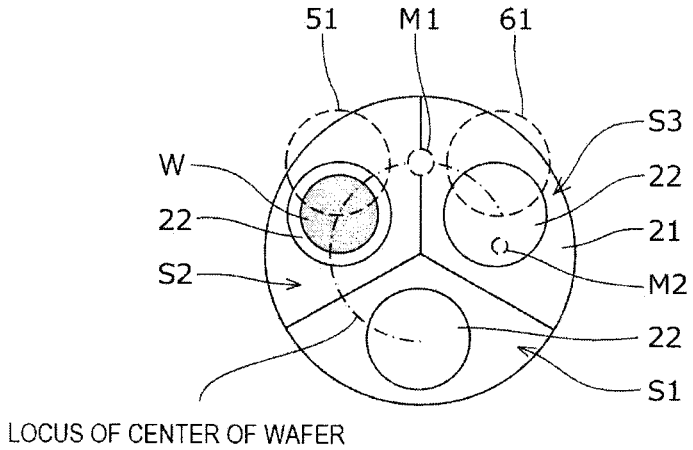
FIGS. 7A to 7C are schematic views illustrating a wafer being transferred toward a fine grinding stage after the rough grinding.
Figure 7B:
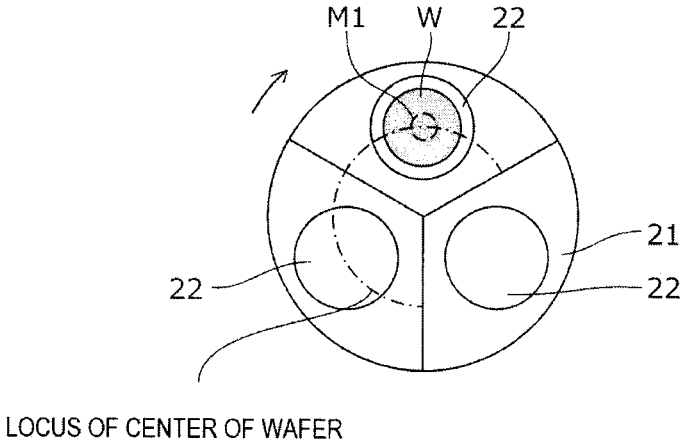
Figure 7C:
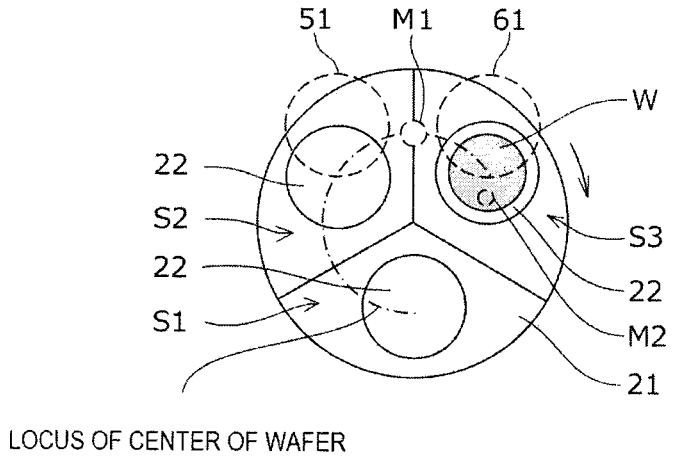
Figure 8A:
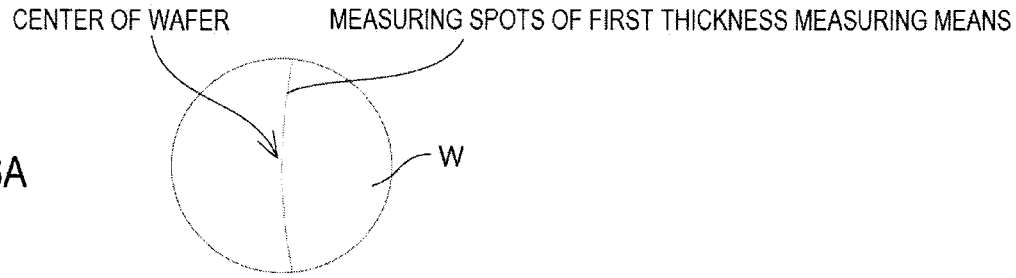
FIGS. 8A to 8D are plan views illustrating the loci of measuring spots of a thickness measuring means.
Figure 8B:
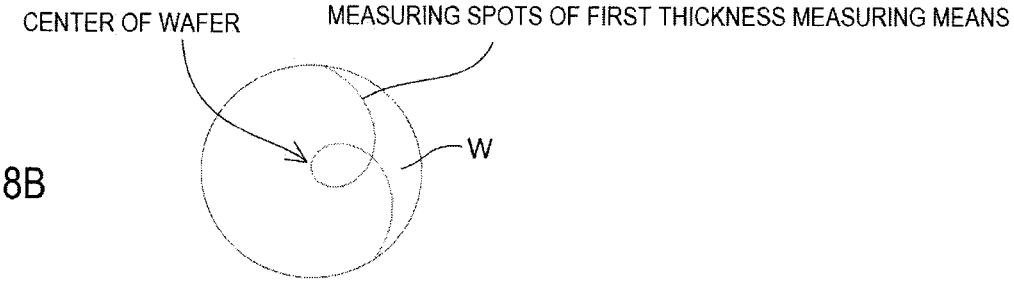
Figure 8C:
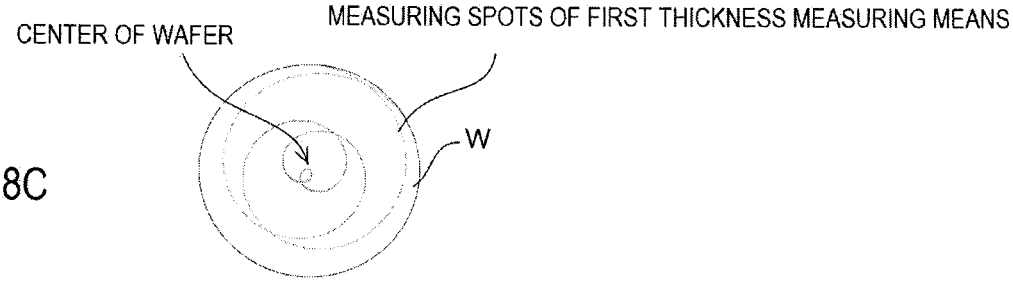
Figure 8D:
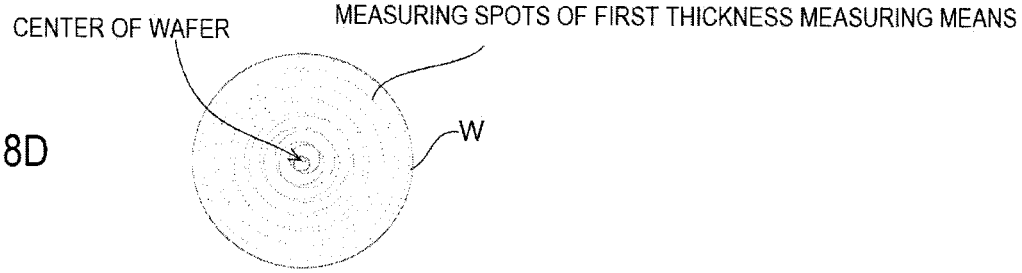
Figure 9A:
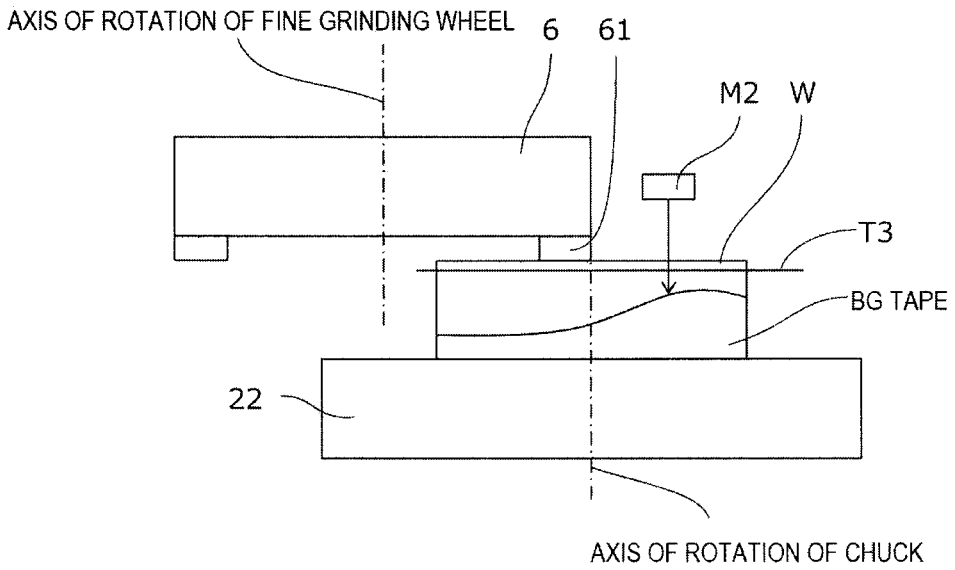
FIGS. 9A and 9B are schematic views illustrating the measurement of the thickness of the wafer before the fine grinding.
Figure 9B:
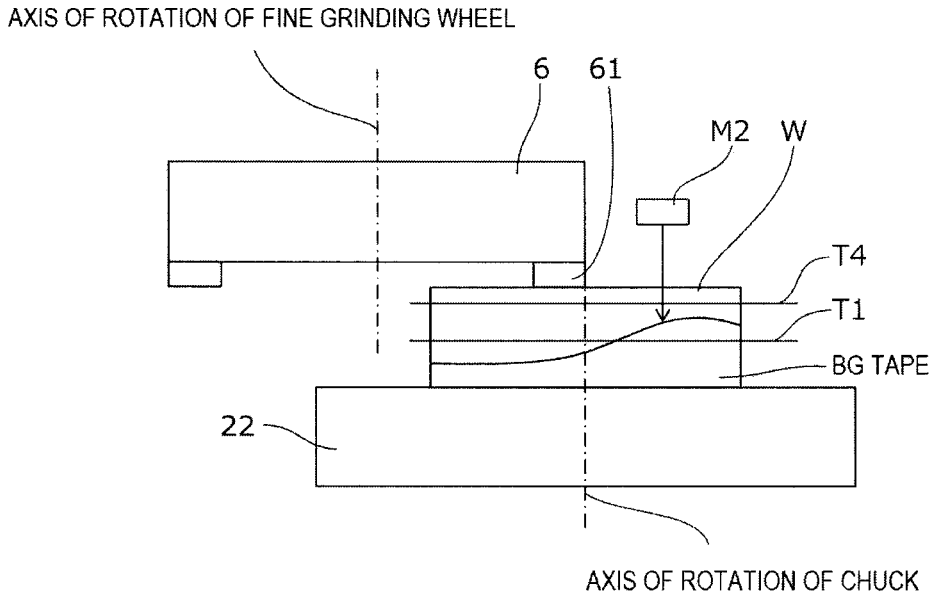

Next, a procedure for adjusting the amount of fine grinding of the fine grinding wheel 61 is described. FIG. 6 is a flowchart illustrating a procedure for performing rough grinding and fine grinding of the wafer W with the grinding apparatus 1. FIGS. 7A to 7C are schematic views illustrating the wafer W being transferred from the rough grinding stage S2 toward the fine grinding stage S3, FIG. 7A illustrating the position of the wafer W disposed in the rough grinding stage S2, FIG. 7B illustrating the wafer W being transferred, FIG. 7C illustrating the position of the wafer W disposed in the fine grinding stage S3. FIGS. 8A, 8B, 8C, 8D are plan views illustrating the loci of measuring spots of the first thickness measuring means M1. FIGS. 9A and 9B are schematic views illustrating the thickness of the wafer W having waviness before fine grinding being measured, FIG. 9A being a schematic view illustrating thickness measurement being performed at the thinnest part of the wafer W, FIG. 9B being a schematic view illustrating a target thickness being set on the basis of the average thickness across an entire surface of the wafer W.

After the wafer W is roughly ground with the rough grinding wheel 51 (step S1), the index table 21 rotates such that the wafer W in the rough grinding stage S2 as shown in FIG. 7A is transferred from the rough grinding stage S2 toward the fine grinding stage S3 (step S2).

The first thickness measuring means M1 measures the thickness of the wafer W after the rough grounding (step S3). Specifically, with the chuck 22 rotating on the axis of rotation a1, the wafer W passes below the first thickness measuring means M1, as shown in FIG. 7B, and thereby the thickness across an entire surface of the wafer W can be measured. In addition, since the center of the wafer W passes immediately below the first thickness measuring means M1, the measuring spots of the first thickness measuring means M1 spread over the entire surface, including the center, of the wafer W.

It should be noted that the measuring spots of the first thickness measuring means M1 is freely adjustable with the transfer speed of the index table 21 and the rotational speed of the chuck 22. For example, as the rotational speed of the chuck 22 increases, the number of scans in a radial direction of the wafer W of the measuring spots of the first thickness measuring means M1 can be increased. FIGS. 8A to 8D illustrate the loci of measuring spots of the first thickness measuring means M1 when the rotational speed of the chuck 22 (number of revolutions of the wafer) is changed to various values under the condition that the wafer size is 4 inches, the angular velocity of the index table 21 is 20 deg/s, and the sampling period is 1 ms (number of measuring points on the wafer: approximately 1100 points), FIGS. 8A, 8B, 8C and 8D illustrating the loci of measuring spots of the first thickness measuring means M1 when the number of revolutions of the wafer is set at 0 rpm (zero revolution), 50 rpm, 400 rpm and 800 rpm, respectively.

Next, the control unit 10 computes an average thickness T1 of the entire wafer W after the rough grinding on the basis of the measured values of step S3 (step S4). In this embodiment, the average thickness T1 of the entire wafer W was 250 μm.

Next, the index table 21 rotates such that the wafer W after the rough grinding is transferred to the fine grinding stage S3 (step S5), and then the second thickness measuring means M2 measures a thickness T2 at one arbitrary point of the wafer W before the fine grinding (step S6). In this embodiment, the thickness T2 was 252 μm.

Then, the control unit 10 computes a corrected target thickness T4 on the basis of the average thickness T1 of the entire wafer W, the thickness T2 at the one arbitrary point of the wafer W, and a target thickness T3 after the fine grinding (step S7). Specifically, since the grinding wheel is located at the center of the wafer W and therefore a measurable range of the thickness of the wafer W during grinding is limited, when the wafer W having waviness is finely ground, if the thickness at the arbitrary measuring point on the wafer W is directly used for the fine grinding without the waviness taken into consideration, the wafer W may be insufficiently ground (see FIG. 9A) when the average thickness across an entire surface of the wafer W is thicker than the thickness at the measuring point (for example, when the wafer W is thick locally at the center), or the wafer W may be excessively ground when the average thickness across an entire surface of the wafer W is thinner than the thickness at the arbitrary measuring point on the wafer W (for example, when the wafer W is thin locally at the center). Therefore, the average thickness across an entire surface of the wafer W is computed by averaging the measured values of the first thickness measuring means M1, and then the corrected target thickness T4 is obtained by subtracting a difference between this average thickness and the target thickness T3 (amount of fine grinding) from the thickness T2 at the one arbitrary point of the wafer W such that the difference is computed from the back side of the wafer W at the measuring spot of the second thickness measuring means M2. That is, the control unit 10 can obtain the corrected target thickness T4 by computing T4=T2−(T1−T3). In this embodiment, when the target thickness T3 is set at 150 μm, the corrected target thickness T4 is 152 μm.

The wafer W is finely ground to the corrected target thickness T4 with the fine grinding wheel 61 (step S8). The thickness of the wafer W is successively measured by the second thickness measuring means M2, and, when the measured value of the second thickness measuring means M2 becomes equal to or less than the corrected target thickness T4, the control unit 10 retreats the fine grinding wheel 61.

It should be noted that the corrected target thickness T4 is preferably computed with a shape variation of the wafer W before and after the fine grinding (a trend of the fine grinding) taken into consideration. Specifically, a dummy wafer is prepared, the dummy wafer is ground according to steps S1 to S8, thereafter a thickness T6 at one arbitrary point on the dummy wafer after the fine grinding is measured using the second thickness measuring means M2, and an average thickness T7 of the entire wafer W after the fine grinding is measured using the first thickness measuring means M1. Then, the control unit 10 computes a correction value T8=(T1−T7)−(T2−T6) involved in the shape variation of the wafer W before and after the fine grinding, and thereby the correction value T8 involved in the shape variation of the wafer W before and after the fine grinding can be obtained. In this embodiment, when the average thickness T1 of the entire dummy wafer before the rough grinding is 300 μm, the thickness T2 at one arbitrary point of the dummy wafer before the rough grinding is 300 μm, the thickness T6 at one arbitrary point of the dummy wafer after the fine grinding is 200 μm, and the average thickness T7 of the entire dummy wafer after the fine grinding is 198 μm, the correction value T8 involved in the shape variation of the wafer W before and after the fine grinding is 2 μm.

Then, by adding the correction value T8 involved in the shape variation of the wafer W before and after the fine grinding to the corrected target thickness T4 computed at step S5, fine grinding of high precision taking into consideration the shape variation of the wafer W before and after the fine grinding can be performed. In this manner, excessive or insufficient grinding, which often occurs when the wafer W having waviness is ground, can be prevented or reduced.

In addition, it is preferred that whether or not the fine grinding was on target be confirmed by measuring the thickness of the wafer W after the fine grinding according to the following procedure. That is, first, the second thickness measuring means M2 measures the thickness at one arbitrary point of the wafer W after the fine grinding (step S9). Then, the index table 21 rotates such that the wafer W after the fine grinding is transferred from the fine grinding stage S3 toward the alignment stage S1 (step S10).

Next, the first thickness measuring means M1 measures the thickness of the wafer W after the fine grinding (step S11), and the control unit 10 computes the average thickness across an entire surface of the wafer W after the fine grinding on the basis of the measured values of step S11 (step S12). Thereby, a target thickness at the arbitrary point on the wafer W can be confirmed on the basis of the measured value of step S9 and, at the same time, whether or not an excessively or insufficiently ground part of the entire wafer W is present can be confirmed on the basis of the computed value of step S12.

Since the grinding apparatus 1 described above measures the thickness of the wafer W while the wafer W is being transferred in this manner, the grinding apparatus 1 can measure the thickness across an entire surface of the wafer W while keeping the throughput, and grind the wafer W precisely to the target thickness.

In addition, since the grinding apparatus 1 corrects the target thickness on the basis of the average thickness across an entire surface of the wafer W taking into consideration whether the wafer W is thin or thick, excessive or insufficient grinding, which often occurs when the wafer W having waviness is ground, can be prevented or reduced.

Further, since the chuck 22 rotates when the chuck 22 passes below the first thickness measuring means M1, the measuring spots of the first thickness measuring means M1 can be scanned on the wafer W without the first thickness measuring means M1 moved, and therefore the thickness across an entire surface of the wafer W can be measured without additional installation of an arm or the like for the first thickness measuring means M1 to scan.

Furthermore, since the thickness across an entire surface of the wafer W including the center of the wafer W is measured the wafer W is being transferred, the thickness across an entire surface of the wafer W including the center can be measured while the throughput of grinding of the wafer W is being kept.

It should be noted that various modifications can be made to the present invention unless they depart from the spirit of the present invention and that the present invention covers such modifications.

What is claimed is:

1. A grinding apparatus provided with a rough grinding stage for roughly grinding a wafer, a fine grinding stage for finely grinding the wafer, and a transfer means for transferring the wafer, the grinding apparatus comprising:

a thickness measuring means for measuring a thickness of the wafer having the measuring spot which is fixed at a position that does not interfere with a grinding wheel, and on a locus of transfer of a center of the wafer while the wafer is being transferred from the rough grinding stage to the fine grinding stage; and a control means for computing a thickness of the wafer before the fine grinding on the basis of measured values of the thickness measuring means and correcting a target thickness after the fine grinding.

2. The grinding apparatus according to claim 1, wherein the control means computes an average thickness across an entire surface of the wafer before the fine grinding on the basis of the measured values of the thickness measuring means and corrects the target thickness after the fine grinding.

3. The grinding apparatus according to claim 1, wherein a wafer chuck for holding the wafer rotates the wafer when the thickness measuring means measures the thickness of the wafer.

4. The grinding apparatus according to claim 1, wherein the thickness measuring means is a non-contact in-process gauge (NCIG) using spectral interference.

5. The grinding apparatus according to claim 1, wherein the thickness measuring means is attached to a column so disposed as to span the transfer means.

6. The grinding apparatus according to claim 1, further comprising a finished thickness measuring means for measuring a thickness at one arbitrary point of the wafer in the fine grinding stage, wherein the control means corrects the target thickness after the fine grinding again on the basis of a correction value involved in a shape variation of the wafer obtained by subtracting a difference in the average thickness across the entire surface of the wafer between before and after the fine grinding measured by the thickness measuring means from a difference in the thickness at one arbitrary point of the wafer between before and after the fine grinding measured by the finished thickness measuring means.

* * * * *